US006422547B1

(12) United States Patent
Gibbens

(10) Patent No.: US 6,422,547 B1
(45) Date of Patent: Jul. 23, 2002

(54) TORSION COIL SPRING

(75) Inventor: Gregory Richard Gibbens, West Gosford (AU)

(73) Assignee: George Gibbons Pty. Ltd., West Gosford (AU)

( * ) Notice: Subject to any disclaimer, the term of this patent is extended or adjusted under 35 U.S.C. 154(b) by 0 days.

(21) Appl. No.: 09/647,384

(22) PCT Filed: Mar. 31, 1999

(86) PCT No.: PCT/AU99/00243

§ 371 (c)(1),
(2), (4) Date: Nov. 28, 2000

(87) PCT Pub. No.: WO99/49760

PCT Pub. Date: Oct. 7, 1999

(30) Foreign Application Priority Data

Mar. 31, 1998 (AU) ..... PP 2691

(51) Int. Cl.[7] ..... F16F 1/06

(52) U.S. Cl. ..... 267/157; 5/255; 267/92; 267/144; 267/75

(58) Field of Search ..... 267/91, 92, 107, 267/142, 143, 144, 155, 156, 157, 75, 26; 5/247, 255, 719

(56) References Cited

U.S. PATENT DOCUMENTS 1,528,125 A * 3/1925 Morse ..... 5/255
4,778,157 A * 10/1988 Thomas ..... 267/103
5,346,190 A * 9/1994 Dabney ..... 267/103
5,497,979 A * 3/1996 Schulz, Jr. et al. ..... 267/103
5,562,274 A * 10/1996 Kitchen et al. ..... 267/103
5,575,460 A * 11/1996 Knopfel ..... 267/91
5,964,453 A * 10/1999 McCraw ..... 267/103

FOREIGN PATENT DOCUMENTS

AU 24871/97 * 6/1996 ..... 267/103
FR 1260901 9/1961
GB 275484 * 8/1927 ..... 267/103
GB 420871 * 12/1934 ..... 267/103

* cited by examiner

*Primary Examiner*—Christopher P. Schwartz
*Assistant Examiner*—Devon Kramer
(74) *Attorney, Agent, or Firm*—Christie, Parker & Hale, LLP

(57) ABSTRACT

A spring suitable for use in bedding construction, including mattresses, mattress-bases and the like which is able to achieve a variety of spring heights and resiliences using the same thickness of wire. The spring includes a first leg (2), a first upper foot (3), a first lower foot (4), a second leg (2), a second upper foot (3), a second lower foot (4), at least one coil spring (5) and linking means (6). The spring's first leg links the first upper foot to the first lower foot and includes at least one coil spring (5) at some point along its length. The spring's second leg links the second upper foot to the second lower foot and includes at least one coil (5) spring at some point along its length. The linking means links the first upper foot to the second upper foot in such a way that the first leg, first upper foot, and first lower foot are oriented at approximately 180 degrees relative to the second leg, second upper foot, and second lower foot.

33 Claims, 6 Drawing Sheets

TORSION COIL SPRING

BACKGROUND

Figure 1:
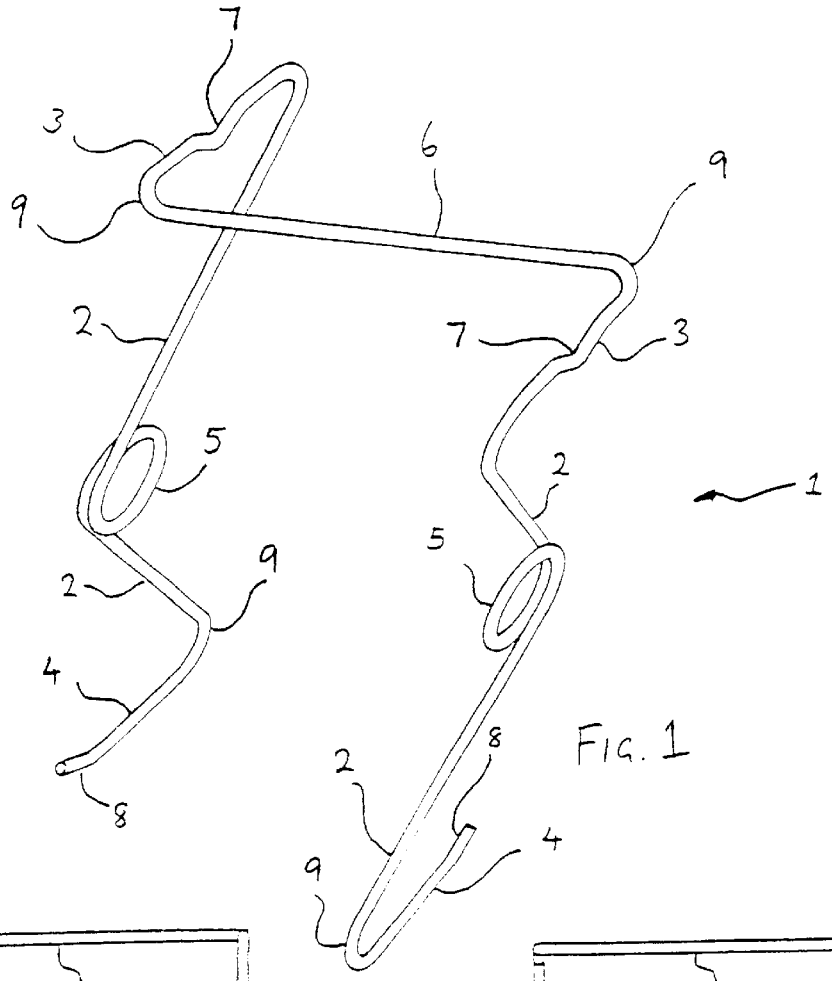

The present invention relates to improvements in spring construction, and especially to bedding springs for use in mattress and/or mattress base construction, or the like.

PRIOR ART

Numerous forms of bedding springs are known according to the prior art. However, many examples of springs according to the prior art give unsatisfactory performance, are not adaptable for alternative light-/medium-/heavy-duty bedding construction and/or for alternative budget or premium markets. In many cases, completely different types of springs are specified for different types of bedding/mattress construction and/or for different priced market sectors.

Some forms of prior art bedding springs are not conducive to economical mass production and/or are not suitable for economical bedding or mattress construction. The bedding manufacturing industry is very competitive and very cost sensitive.

A further disadvantage of known bedding springs are that in order to achieve different spring heights or resilience levels, different thicknesses of spring wire must be used. Having to change from one type of wire to another increases manufacture time and cost.

OBJECTS OF THE PRESENT INVENTION

It is an object of the present invention to provide an improved form of spring suitable for use in bedding manufacture which overcomes or at the least minimises the prior art problems referred to above.

It is a further object of this invention to provide an improved form of spring suitable for use in bedding construction which at the very least provides consumers and bedding manufacturers with an alternative choice to prior art spring and bedding manufacture.

It is an additional object of this invention to provide an improved form of spring suitable for use in bedding construction which is able to achieve a variety of spring resiliences using the same thickness of wire.

It is a further object of this invention to provide an improved form of spring suitable for use in bedding construction which is suitable for use with a variety of thicknesses of mattress using the same thickness of wire.

It is another object of this invention to provide a bedding spring of variable construction to satisfy the variable requirements of the market as to end product function and/or quality.

It is vet a further object of this invention to provide mattresses, mattress-bases and other forms of bedding or the like which include springs of the form as herein described in their construction.

These and other objects of the invention will be apparent from the following further but non-limiting, disclosure of the invention.

THE INVENTION

According to one aspect of the present invention, there is provided a spring suitable for use in bedding construction, including mattresses, mattress-bases and the like, which in front elevation has a nominal inverted-U construction or profile with two depending spaced-apart leg portions joined together at their upper end by a bight portion which in plan view extends diagonally from the front edge of one said leg portion to the rear edge of the adjacent or other leg portion, wherein the one said leg portion in end elevation has generally M-shaped (or W-shaped) profile rotated through 90° and said other leg portion has a generally M-shaped (or W-shaped) profile rotated through 90° but in the opposite direction to the direction of rotation of the first or one said leg portion, wherein said spring is of unitary or contiguous construction, and wherein each said leg portion includes at least one coil spring in its construction, preferably located at one or more bight portions of the M- or W-profile, and wherein each coil spring may comprise one or a plurality of coils.

According to another aspect of the present invention, there is provided a mattress, mattress-base or other form of bedding or the like having a frame which includes a plurality of springs of the above type in its construction.

According to a further aspect of the present invention there is provide a spring suitable for use in bedding construction, including mattresses, mattress-bases and the like including at least one leg, at least one upper foot, at least one lower foot and at least one coil spring wherein said at least one leg links said at least one upper foot to said at least one lower foot and includes said at least one coil spring at some point along its length.

Preferably said at least one coil spring has an axis of rotation which is substantially perpendicular to the plane of orientation of said at least one leg.

Preferably said at least one coil spring includes at least one 360 degree turn.

Preferably said at least one coil spring is located at the junction between said at least one leg and said at least one upper foot.

Preferably said at least one coil spring is located at the junction between said at least one leg and said at least one lower foot.

Preferably said at least one coil spring is located on said at least one leg at a point substantially midway between the upper foot and the lower foot.

Preferably said at least one leg has a profile including at least one peak or trough.

Preferably said at least one leg has a profile including a series of peaks and troughs.

Preferably said series of peaks and troughs forms a generally zig-zag shaped profile.

Preferably said at least one leg includes at least one coil spring located at one or more of the peaks or troughs.

Preferably said at least one leg has one peak or trough and has a generally V-shaped (or U-shaped) profile.

Preferably said at least one leg includes one coil spring located at the peak or trough of its V-shaped (or U-shaped) profile.

Preferably said at least one leg includes a first coil spring located at the junction between said at least one leg and said at least one upper foot and a second coil spring located at the junction between said at least one leg and said at least one lower foot.

Preferably including a third coil spring located at the peak or trough of said at least one leg.

Preferably said at least one upper foot includes at least one kink at some point-along its length to prevent movement of said spring when fixed to a body of a mattress.

Preferably said at least one lower foot includes at least one kink at its free end to prevent movement of said spring, when fixed to a main framing of a mattress.

According to a further aspect of the present invention there is provided a spring substantially as described here including a first leg, a first upper foot, a first lower foot, a second leg, a second upper foot, a second lower foot, at least one coil spring and linking means wherein said first leg links said first upper foot to said first lower foot and includes at least one coil spring at some point along its length, and wherein said second lea links said second upper foot to said second lower foot and includes at least one coil spring at some point along its length, and wherein said linking means links said first upper foot to said second upper foot.

Preferably said first leg, first upper foot, and first: lower foot have substantially the same shape as said second leg, second upper foot, and second lower foot.

Preferably said linking means links a toe of said first upper foot to a toe of said second upper foot.

Preferably said linking means links the toe of said first upper foot to the toe of said second upper foot so that said first leg, first upper foot, and first lower foot are oriented at approximately 180 degrees relative to said second leg, second upper foot, and second lower foot.

Preferably said linking means extends substantially diagonally from the toe of said first upper foot to the toe of said second upper foot.

Preferably said spring is of unitary or contiguous construction.

Preferably said spring is made from a single piece of wire or similar material.

Figure 2:
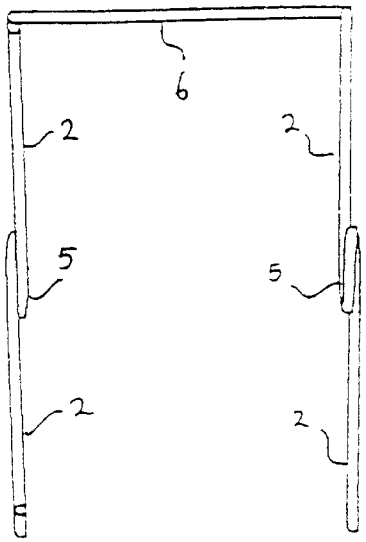
Figure 3:
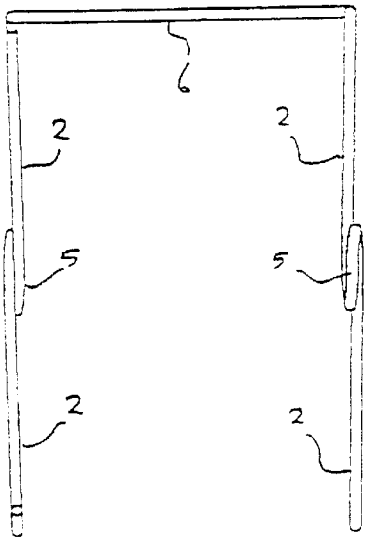
Figure 4:
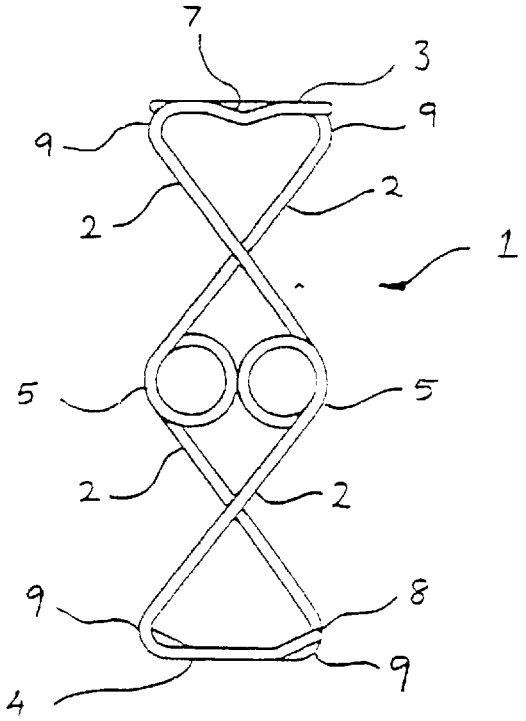
Figure 5:
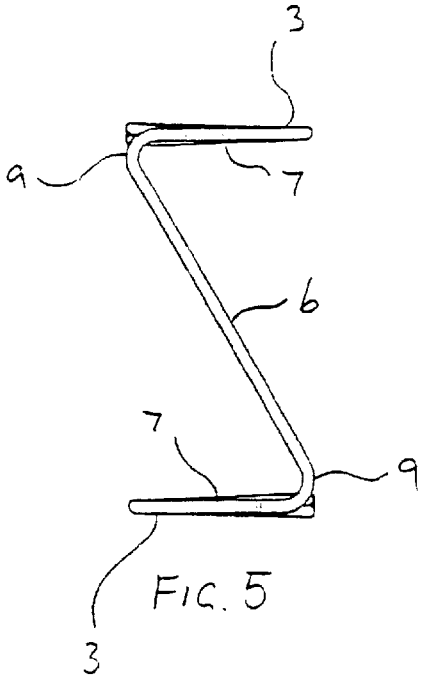

The present invention will now be described in more detail according to three preferred but non-limiting embodiments and with reference to the accompanying FIG. 1: Is a perspective view of the first preferred embodiment of the present invention FIG. 2: Is a front elevation view of the first preferred embodiment of the present invention FIG. 3: Is a rear elevational view of the first preferred embodiment of the present invention;

FIG. 4: Is a side elevational view of the first preferred embodiment of the present invention;

FIG. 5: Is a top view of the first preferred embodiment of the present

Figure 6:
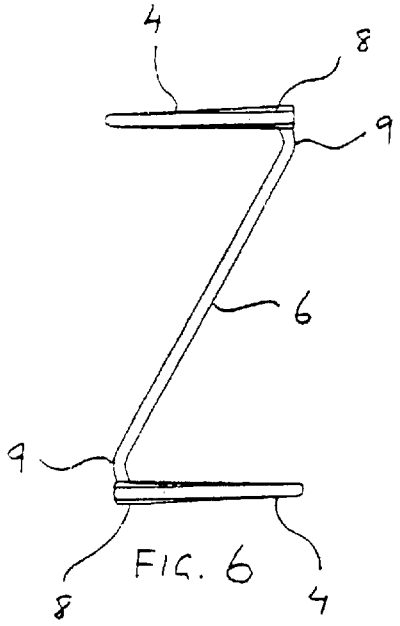
Figure 7:
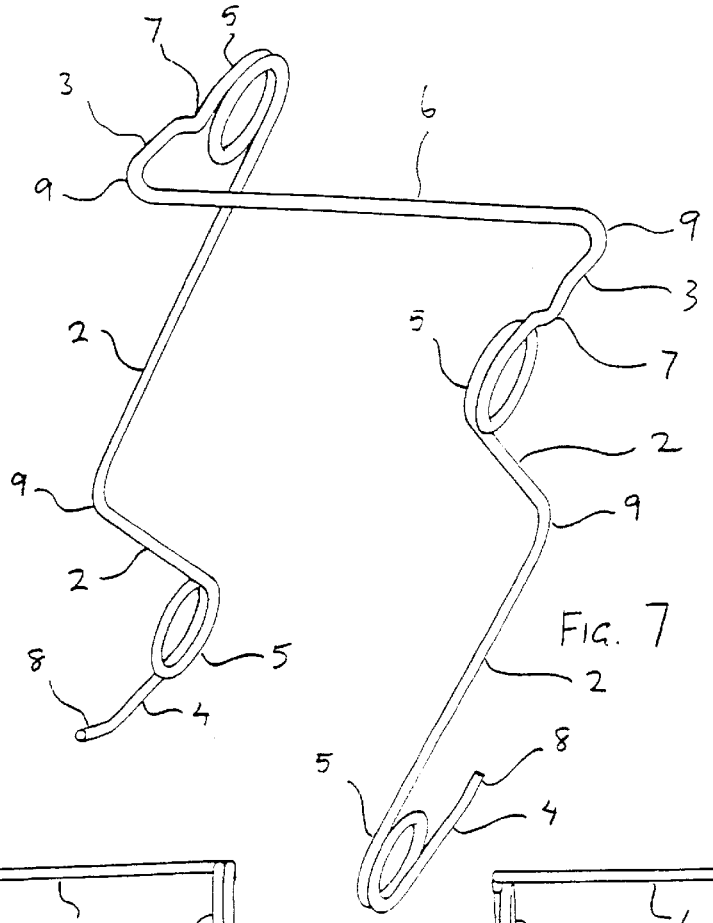
Figure 8:
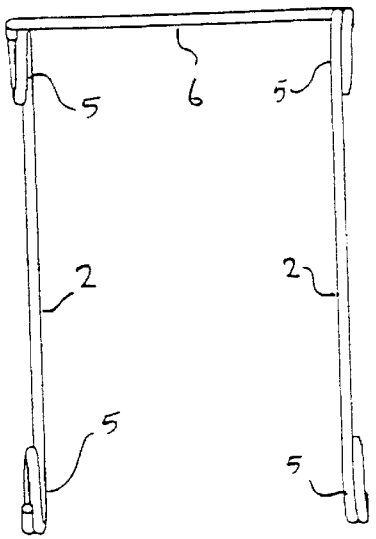
Figure 9:
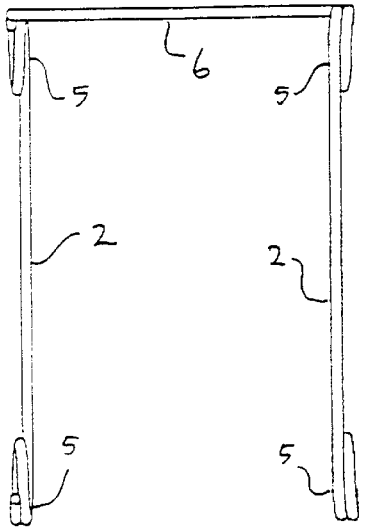
Figure 10:
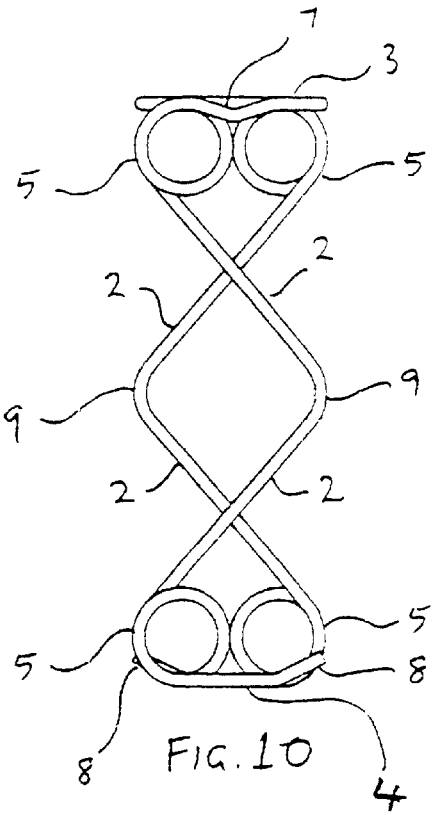
Figure 11:
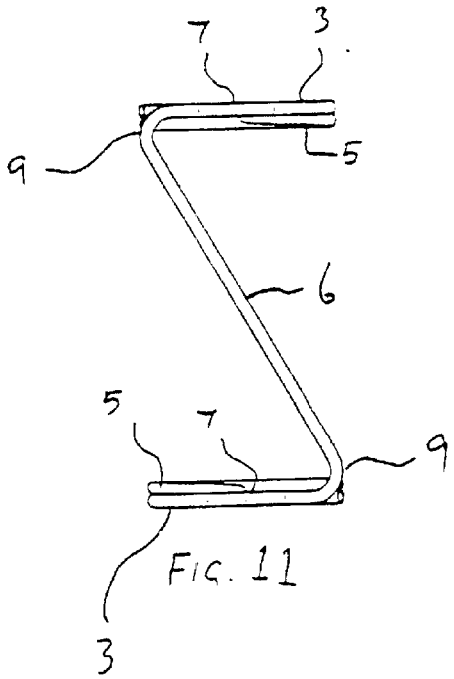
Figure 12:
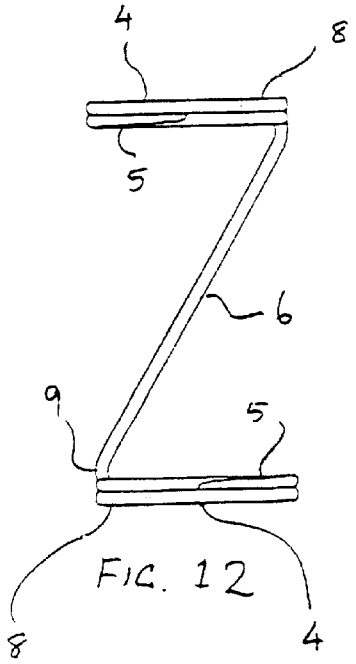
Figure 13:
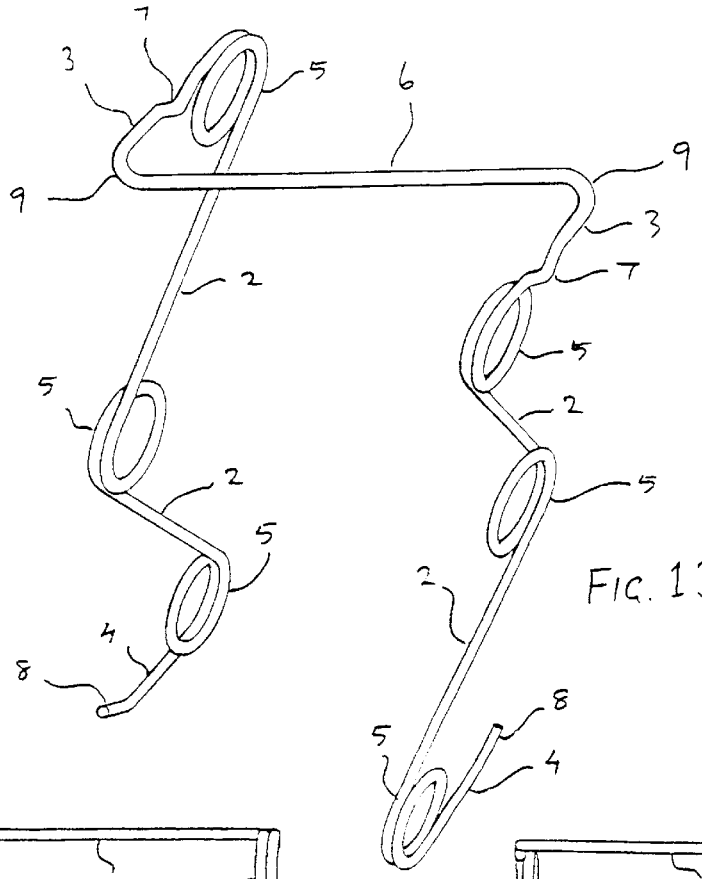
Figure 14:
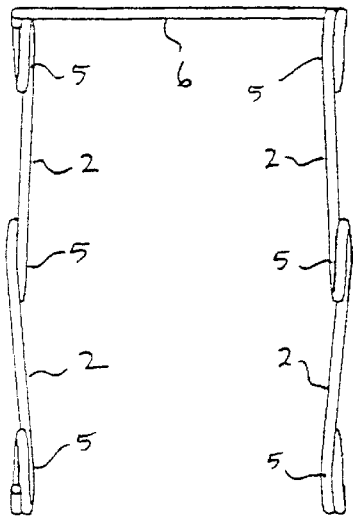
Figure 15:
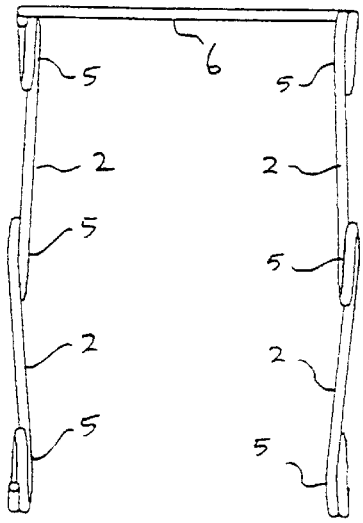
Figure 16:
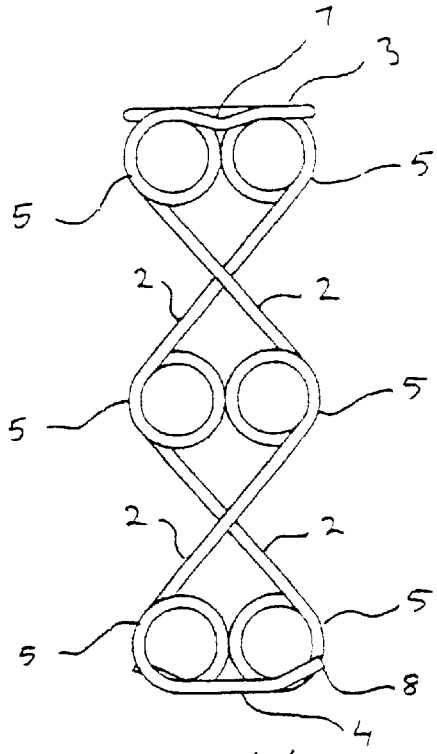
Figure 17:
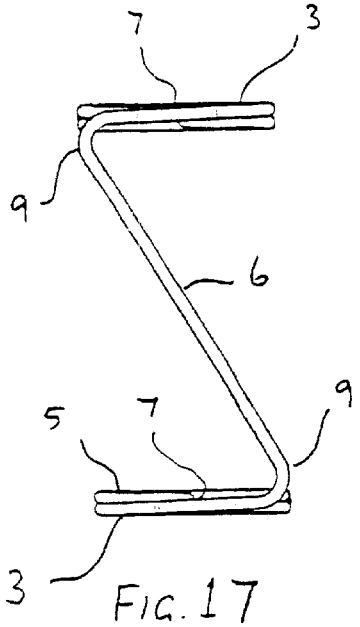
Figure 18:
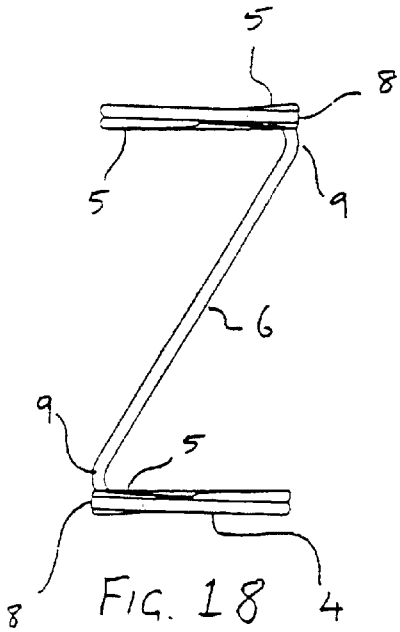

FIG. 6: Is a bottom view of the first preferred embodiment of the present invention;

FIG. 7: Is a perspective view of the second preferred embodiment of the present invention;

FIG. 8: Is a front elevational view of the second preferred embodiment of the present invention;

FIG. 9: Is a rear elevational view of the second preferred embodiment of the present invention;

FIG. 10: Is a side elevational view of the second preferred embodiment of the present invention;

FIG. 11: Is a top view of the second preferred embodiment of the present invention;

FIG. 12: Is a bottom view of the second preferred embodiment of the present invention;

FIG. 13: Is a perspective view of the third preferred embodiment of the present invention;

FIG. 14: Is a front elevational view of the third preferred embodiment of the present invention;

FIG. 15: Is a rear elevational view of the third preferred embodiment of the present invention;

FIG. 16: Is a side elevational view of the third preferred embodiment of the present invention;

FIG. 17: Is a top view of the third preferred embodiment of the present invention;

FIG. 18: Is a bottom view of the third preferred embodiment of the present invention;

FIRST PREFERRED EMBODIMENT (FIGS. 1 to 6)

As can be seen in FIGS. 1 to 6 the first preferred embodiment of the spring 1 of the present invention includes two legs 2, two upper feet 3, two lower feet 4, two coils 5, a link 6, two kinks 7 and two bends 8. The return portion or "kink" 7 on the end of both lower feet 4 is present to prevent the bottom portion of the spring 1 from slipping out of the ties and/or fixings used to fasten the spring to the main framing of the mattress (not shown). The length and angle of the return or "kink" 7 are variable depending on the ties and/or fixings used. In some cases, where a return portion or kink 7 is not required, the wire would be straight, without a "kink 7".

The radius 9 at the bottom and top of both legs 2 prevents stress concentrations at these points when the spring 1 is compressed and can be varied according to the degree of flexibility required in the spring 1 as a whole.

The diameter of the coil 5, which would usually, but not always, be situated in the middle of the overall height, is varied to achieve a stiffer or softer spring as required for individual applications. A smaller diameter would result in a stiffer spring 1, while a larger diameter would give a softer spring 1. If an extremely soft spring 1 is required, two or even three turn coils 5 could be used instead of the single turn coils 5 illustrated.

Similar in application to the kinks 7, the bends 8 at the extremities of the lower feet 4 are used to prevent movement of the top pan of the spring 1 when fixed to the body of a mattress (not shown). The width, depth and position of these bends 8 would also be determined by the ties and/or fixing,s used to fasten the spring 1 to the main framing of the mattress (not shown). With some methods of fixing it would not be necessary to have a bend 8, and the wire would be left straight.

Radii 9 avoid stress concentrations at points where the wire is bent. Ideally these radii 9 should be as large as possible while still allowing for the spring 1 to be secured to the mattress frame (not shown).

The overall length of the spring form 1 determines the number of supports in the mattress frame per unit length. A shorter overall length would allow more spring forms 1 to be used providing for a stronger mattress. A longer overall length would result in fewer spring forms 1 being used, resulting in a softer mattress. The overall design of the mattress frame would also dictate the overall length required.

The overall width of the spring form 1 has a bearing on the stiffness of the spring 1 as a whole. A narrow spring 1 would be relatively stiff, while a wider spring 1 would be softer. The overall design of the mattress frame would also dictate the overall width required.

The overall height of the spring form 1 is determined by the thickness of the mattress to which it is being, fitted. The overall height also has a bearing, on the overall stiffness of the spring 1. A spring form 1 with a greater height would be stiffer than a spring With a shorter height.

SECOND PREFERRED EMBODIMENT (FIGS. 7 to 13)

As can be seen in FIGS. 7 to 13 the second preferred embodiment of the spring 1 of the present invention includes two legs 2, two upper feet 3, two lower feet 4, four coils 5, a link 6, two kinks 7 and two bends 8. The return portion or "kink" 7 on the end of both lower feet 4 is present to prevent the bottom portion of the spring 1 from slipping out of the ties and/or fixings used to fasten the spring to the main framing of the mattress (not shown). The length and angle of the return or kink 7 are variable depending on the ties and/or fixings used. In some cases, where a return portion or kink 7 is not required, the wire would be straight, without a "kink 7".

The diameter of the coils 5 is varied to achieve a stiffer or softer spring 1 as required for individual applications. A smaller diameter would result in a stiffer spring 1, while a larger diameter would give a softer spring 1. If an extremely soft spring 1 is required, two or even three turn coils 5 could be used instead of the single turn coils 5 illustrated.

The radii 9, which would usually, but not always, be situated in the middle of the overall heights, prevent stress concentrations at these points when the spring 1 is compressed and can be varied according to the degree of flexibility required in the spring 1.

Similar in application to the kinks 7, the bends 8 at the extremities of the lower feet 4 are used to prevent movement of the top part of the spring 1 when fixed to the body of a mattress (not shown). The width, depth and position of these bends 8 would also be determined by the ties and/or fixings used to fasten the spring 1 to the main framing of the mattress (not shown). With some methods of fixing it would not be necessary to have a bend 8, and the wire would be left straight.

Radii 9 avoid stress concentrations at points where the wire is bent. Ideally these radii 9 should be as large as possible while still allowing for the spring 1 to be secured to the mattress frame (not shown).

The overall length of the spring form 1 determines the number of supports in the mattress frame per unit length. A shorter overall length would allow more spring forms 1 to be used providing for a stronger mattress. A longer overall length would result in fewer spring forms 1 being used, resulting in a softer mattress. The overall design of the mattress frame would also dictate the overall length required.

The overall width of the spring form 1 has a bearing on the stiffness of the spring 1 as a whole. A narrow spring 1 would be relatively stiff, while a wider spring 1 would be softer. The overall design of the mattress frame would also dictate the overall width required. The overall height of the spring form 1 is determined by the thickness of the mattress to which it is being fitted. The overall height also has a bearing on the overall stiffness of the spring 1. A spring form 1 with a greater height would be stiffer than a spring with a shorter height.

THIRD PREFERRED EMBODIMENT (FIGS. 13 to 18)

As can be seen in FIGS. 13 to 18 the third preferred embodiment of the spring 1 of the present invention includes two legs 2, two upper feet 3, two lower feet 4, six coils 5, a link 6, two kinks 7 and two bends 8. The return portion or "kink"7 on the end of both lower feet 4 is present to prevent the bottom portion of the spring 1 from slipping out of the ties and/or fixings used to fasten the spring to the main framing of the mattress (not shown). The length and angle of the return or kink 7 are variable depending on the ties and/or fixings used. In some cases, where a return portion or kink 7 is not required, the wire would be straight, without a "kink 7".

The diameter of the coils 5 is varied to achieve a stiffer or softer spring 1 as required for individual applications. A smaller diameter would result in a stiffer spring 1, while a larger diameter would give a softer spring 1. If an extremely soft spring 1 is required, two or even three turn coils 5 could be used instead of the single turn coils 5 illustrated.

The radius 9 at the bottom and top of both legs 2 prevents stress concentrations at these points when the spring 1 is compressed and can be varied according to the degree of flexibility required in the spring 1 as a whole.

Similar in application to the kinks 7, the bends 8 at the extremities of the lower feet 4 are used to prevent movement of the top part of the spring 1 when fixed to the body of a mattress (not shown). The width, depth and position of these bends 8 would also be determined by the ties and/or fixings used to fasten the spring 1 to the main framing of the mattress (not shown). With some methods of fixing it would not be necessary to have a bend 8, and the wire would be left straight.

Radii 9 avoid stress concentrations at points where the wire is bent, ideally these radii 9 should be as large as possible while still allowing for the spring 1 to be secured to the mattress frame (not shown).

The overall length of the spring form 1 determines the number of supports in the mattress frame per unit length. A shorter overall length would allow more spring forms 1 to be used providing for a stronger mattress. A longer overall length would result in fewer spring forms 1 being used, resulting in a softer mattress. The overall design of the mattress frame would also dictate the overall length required.

The overall width of the spring form 1 has a bearing on the stiffness of the spring 1 as a whole. A narrow spring 1 would be relatively stiff, while a wider spring 1 would be softer. The overall design of the mattress frame would also dictate the overall width required.

The overall height of the spring form 1 is determined by the thickness of the mattress to which it is being fitted. The overall height also has a bearing on the overall stiffness of the spring 1. A spring form 1 with a greater height would be stiffer than a spring with a shorter height.

Springs according to the present invention are fabricated from suitable wire grades known in the art to spring and bedding manufacturers. Similarly bedding utilising such springs is manufactured according to techniques known to bedding manufacturers.

Although the invention has been described with reference to examples and drawings relating to preferred embodiments of the invention, it will be appreciated by persons to whom this specification is addressed that the invention is not limited thereto or thereby, and that alternatives to and modifications of specifically described features may be made or included without departing from the spirit or scope of the invention as disclosed herein. All such alternatives and modifications are thereby intended to be included as part of this invention.

What is claimed is:

1. A spring suitable for use in bedding construction, said spring including a first leg, a first upper foot, a first lower foot, wherein said first leg, first upper foot and first lower foot are substantially coplanar said spring further including a second leg, a second upper foot, and a second lower foot wherein said second leg, second upper foot and second lower foot are substantially coplanar, wherein said first leg links said first upper foot to said lower foot and includes at least one coil spring at some point along its length; wherein said second leg links said second upper foot to said second lower foot and includes at least one coil spring at some point along its length; wherein a linking means links said first upper foot to said second upper foot and extends transversely from said first upper foot and said second upper foot; wherein the junction between the first upper foot and the first leg is defined by either a single bend radius lying substantially in the plane of the first leg, or a single coil; and wherein the junction between the second upper foot and the second leg is defined by either a single bend radius lying substantially in the plane of the second leg, or a single coil.

2. The spring as claimed in claim 1 wherein said first leg, first upper foot, and first lower foot have substantially the same shape as said second leg, second upper foot, and second lower foot.

3. The spring as claimed in either of claims 1 or 2 wherein said linking means links a toe of said first upper foot to a toe of said second upper foot.

4. The spring as claimed in claim 3 wherein said linking means links the toe of said first upper foot to the toe of said second upper foot so that said first leg, first upper foot, and first lower foot are oriented at approximately 180 degrees relative to said second leg, second upper foot, and second lower foot.

5. The spring as claimed in claim 3 wherein said linking means extends substantially diagonally from the toe of said first upper foot to the toe of said second upper foot.

6. The spring as claimed in claim 1 wherein said at least one coil spring has an axis of rotation which is substantially perpendicular to the plane of orientation of the first or second leg which it is situated on.

7. The spring as claimed in claim 6 wherein said at least one coil spring includes at least one 360 degree turn.

8. The spring as claimed in claim 1 wherein said at least one coil spring is located at the junction between said first leg and said first upper foot.

9. The spring as claimed in claim 1 wherein said at least one coil spring is located at the junction between said second leg and said second upper foot.

10. The spring as claimed in claim 1 wherein said at least one coil spring is located at the junction between said first leg and said first lower foot.

11. The spring as claimed in claim 1 wherein said at least one coil spring is located at the junction between said second leg and said second lower foot.

12. The spring as claimed in claim 1 wherein said at least one coil spring is located on said first leg at a point substantially midway between the first upper foot and the first lower foot.

13. The spring as claimed in claim 1 wherein said at least one coil spring is located on said second leg at a point substantially midway between the second upper foot and the second lower foot.

14. The spring as claimed in claim 1 wherein said first leg has a profile including at least one peak or trough.

15. The spring as claimed in claim 1 wherein said second leg has a profile including at least one peak or trough.

16. The spring as claimed in claim 14 wherein said first leg has a profile including a series of peaks or troughs.

17. The spring as claimed in claim 14 wherein said second leg has a profile including a series of peaks and troughs.

18. The spring as claimed in either of claim 16 or 17 wherein said series of peaks and troughs forms a generally zig-zag shaped profile.

19. The spring as claimed in claim 16 wherein said first leg includes at least one coil spring located at one or more of the peaks or troughs.

20. The spring as claimed in claim 16 wherein said second leg includes at least one coil spring located at one or more of the peaks or troughs.

21. The spring as claimed in claim 14 wherein said first leg has one peak or trough and has a generally V-shaped or U-shaped profile.

22. The spring as claimed in claim 14 wherein said second leg has one peak or trough and has a generally V-shaped or U-shaped profile.

23. The spring as claimed in claim 21 wherein said first leg includes one coil spring located at the peak or trough of its V-shaped or U-shaped profile.

24. The spring as claimed in claim 22 wherein said second leg includes one coil spring located at the peak or trough of its V-shaped or U-shaped profile.

25. The spring as claimed in claim 1 wherein said first leg includes a first coil spring located at the junction between said first leg and said first upper foot and a second coil spring located at the junction between said first leg and said first lower foot, and wherein said second leg includes a third coil spring located at the junction between said second leg and said second upper foot and a fourth coil spring located at the junction between said second leg and said second lower foot.

26. The spring as claimed in claim 25 further including a fifth coil spring located at the peak or trough of said first leg and a sixth coil spring located at the peak or trough of said second leg.

27. The spring as claimed in claim 1 wherein said first upper foot includes at least one kink at some point along its length to prevent movement of said spring when fixed to a body of a mattress.

28. The spring as claimed in claim 1 wherein said second upper foot includes at least one kink at some point along its length to prevent movement of said spring when fixed to a body of a mattress.

29. The spring as claimed in claim 1 wherein said first lower foot includes at least one kink at its free end to prevent movement of said spring when fixed to a main framing of a mattress.

30. The spring as claimed in claim 1 wherein said second lower foot includes at least one kink at its free end to prevent movement of said spring when fixed to a main framing of a mattress.

31. The spring as claimed in claim 1 wherein said spring is of unitary or contiguous construction.

32. The spring as claimed in claim 31 wherein said spring is made from a single piece of wire or similar material.

33. The spring as claimed in claim 1 wherein the first upper foot extends toward the second leg at an acute angle from the first leg as measured along the second leg and wherein the second upper foot extends toward the first leg at an acute angle from the second leg as measured along the first leg.

* * * * *